US007237534B2

(12) United States Patent
Imamura

(10) Patent No.: US 7,237,534 B2
(45) Date of Patent: Jul. 3, 2007

(54) VEHICLE

(75) Inventor: Takaaki Imamura, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 43 days.

(21) Appl. No.: 11/204,785

(22) Filed: Aug. 16, 2005

(65) Prior Publication Data

US 2006/0037585 A1 Feb. 23, 2006

(30) Foreign Application Priority Data

Aug. 23, 2004 (JP) ..... 2004-241765

(51) Int. Cl.
*F02M 55/02* (2006.01)
*F02M 35/10* (2006.01)

(52) U.S. Cl. ..... 123/470; 123/184.21

(58) Field of Classification Search ..... 123/470, 123/184.21
See application file for complete search history.

(56) References Cited

U.S. PATENT DOCUMENTS 5,167,211 A * 12/1992 Fukuma et al. ..... 123/308
5,269,275 A * 12/1993 Dahlgren ..... 123/492
5,819,706 A * 10/1998 Tsuchida et al. ..... 123/432
6,202,626 B1 * 3/2001 Ito et al. ..... 123/336
6,640,785 B2 * 11/2003 Almkvist ..... 123/492
6,843,219 B2 * 1/2005 Matsuda et al. ..... 123/184.21
7,025,046 B2 * 4/2006 Ikeda et al. ..... 123/470
2005/0205067 A1 * 9/2005 Koide et al. ..... 123/470

FOREIGN PATENT DOCUMENTS

JP 2000-249028 9/2000
JP 2002-037165 2/2002
JP 2004-182017 7/2004

* cited by examiner

*Primary Examiner*—Thomas Moulis
(74) *Attorney, Agent, or Firm*—Keating & Bennett, LLP

(57) ABSTRACT

A vehicle is capable of improving layout flexibility for a fuel injector to an intake passage and preventing fuel from sticking to the inner wall surface of the intake passage. The vehicle includes an engine, an intake passage arranged to supply air to the engine, and a fuel injector mounted on a midsection of the intake passage and arranged to supply fuel to the engine. The intake passage is arranged to continue from the inlet opening of the engine. The intake passage includes an intake passage portion having an upper section extending upward substantially in the vertical direction and an intake passage portion arranged to continue from the upper section of the intake passage portion and have a section bent in the lateral direction of the vehicle body. The fuel injector is mounted to the intake passage portion having the section that is bent in the lateral direction of the vehicle body.

13 Claims, 12 Drawing Sheets

VEHICLE

BACKGROUND OF THE INVENTION

1. Field of the Invention

The present invention relates to a vehicle, and more particularly to a vehicle provided with a fuel injector for supplying fuel to an engine.

2. Description of the Related Art

As a conventional type of such vehicle, a motorcycle provided with a fuel injector for supplying fuel to the engine is well known. See, for example, Patent Documents JP-A-2000-249028, JP-A-2004-182017, and JP-A-2002-037165.

The first two patents disclose a motorcycle having an intake pipe (intake passage) disposed below a body frame and including a bent portion that extends forward and upward from the engine and a fuel injection valve (fuel injector) attached on an upper surface side (body frame side) of the bent portion of the intake pipe that extends forward and upward.

The third patent discloses a motorcycle including an inlet port arranged to continue from an opening end (inlet opening) of a combustion chamber of an engine, an intake pipe arranged to continue from the top end of the inlet port, the intake pipe having a bottom side that extends substantially in the same direction as the inlet port, and an electromagnetic fuel injection valve (fuel injector) mounted on the bottom side of the intake pipe.

A structure of the motorcycle disclosed in the first two patents has the fuel injection valve mounted on the upper surface side (body frame side) of the bent portion of the intake pipe that extends forward and upward. Thus, angling the fuel injection valve forward undesirably causes the topside thereof to touch the intake pipe. Therefore, the structure disclosed in the first two patents makes it difficult for the fuel injection valve to be angled forward from the vehicle body. This results in a problem of less layout flexibility for the fuel injection valve (fuel injector) to the intake pipe (intake passage).

In addition, in the structure of the motorcycle disclosed in the third patent, the bottom side of the intake pipe is formed so as to extend substantially in the same direction as the inlet port, while an injection portion of the fuel injection valve (fuel injector) needs to be mounted so as to cross the direction in which the intake pipe extends. This causes a disadvantage that the injection portion of the fuel injection valve has to be arranged such that it crosses the direction in which the inlet port extends in the intake system. Then, there arises a problem of a tendency for fuel ejected from the injection portion to stick to an inner wall surface of the inlet port in the intake system.

SUMMARY OF THE INVENTION

In order to overcome the problems described above, preferred embodiments of the present invention provide a vehicle capable of improving layout flexibility for the fuel injector to the intake passage and preventing fuel from sticking to the inner wall surface of the intake passage.

A vehicle according to a preferred embodiment includes a head pipe, a body frame coupled with the head pipe and extending downward to the rear, an engine arranged below the body frame, a cylinder axis of the engine being oriented substantially horizontal, an intake passage for supplying air to the engine, and a fuel injector mounted on a midsection of the intake passage for supplying fuel to the engine. The intake passage includes a first intake passage portion formed to continue from an inlet port of the engine and have an upper section that extends upward substantially in the vertical direction and a second intake passage portion formed to continue from the upper section of the first intake passage portion and have a section bent in the lateral direction of the vehicle body. The second intake passage portion has a section that is bent in the lateral direction of the vehicle body, to which section the fuel injector is mounted.

As for the vehicle according to the present preferred embodiment, in the underbone type motorcycle including a body frame extending downward to the rear of the head pipe, the intake passage is provided with the first intake passage portion arranged to continue from the inlet port of the engine and have an upper section extending upward substantially in the vertical direction and the second intake passage portion arranged to continue from the upper section of the first intake passage portion and have a section bent in the lateral direction of the vehicle body. Also, the fuel injector is attached to the section that is bent in the lateral direction of the vehicle body in the second intake passage portion. This can prevent the topside of the fuel injector from touching the intake passage, even though the fuel injector is angled forward. Therefore, the layout flexibility for the fuel injector to the intake passage portion of the intake passage can be improved.

The fuel injector is mounted to the section that is bent in the lateral direction of the vehicle body in the second intake passage portion which is arranged to continue from the first intake passage portion that has the upper section extending upward substantially in the vertical direction. This allows the injection portion of the fuel injector to be arranged in the direction in which the first intake passage portion of the intake passage extends. This can prevent fuel from sticking to the inner wall surface of the intake passage (first intake passage portion).

Other features, elements, characteristics and advantages of the present invention will be apparent from the following detailed description of preferred embodiments with reference to the attached drawings.

DETAILED DESCRIPTION OF PREFERRED EMBODIMENTS

Figure 1:
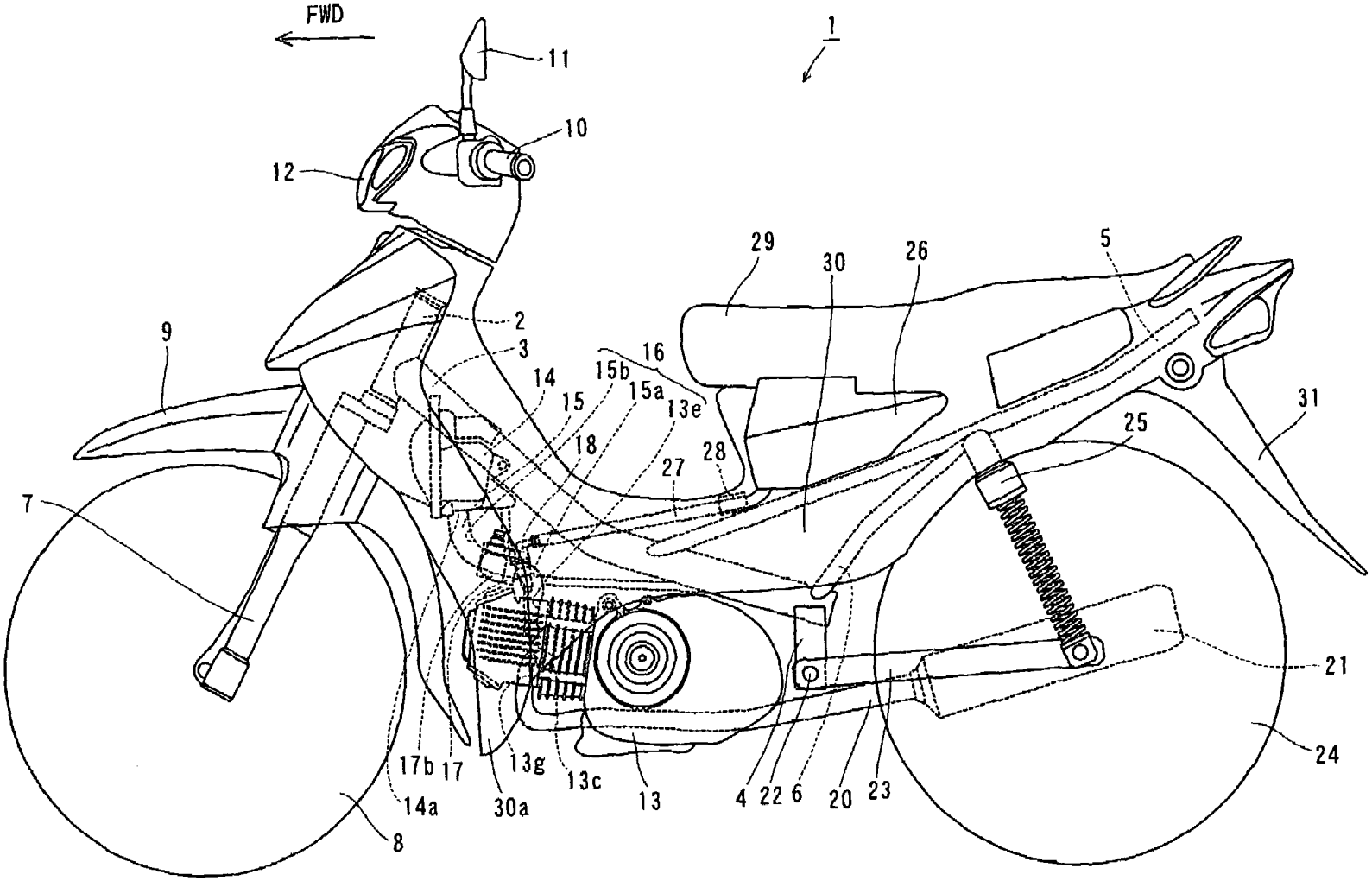
FIG. 1 is a side view of a motorcycle according to a preferred embodiment of the present invention, showing the entire structure thereof.
Figure 2:
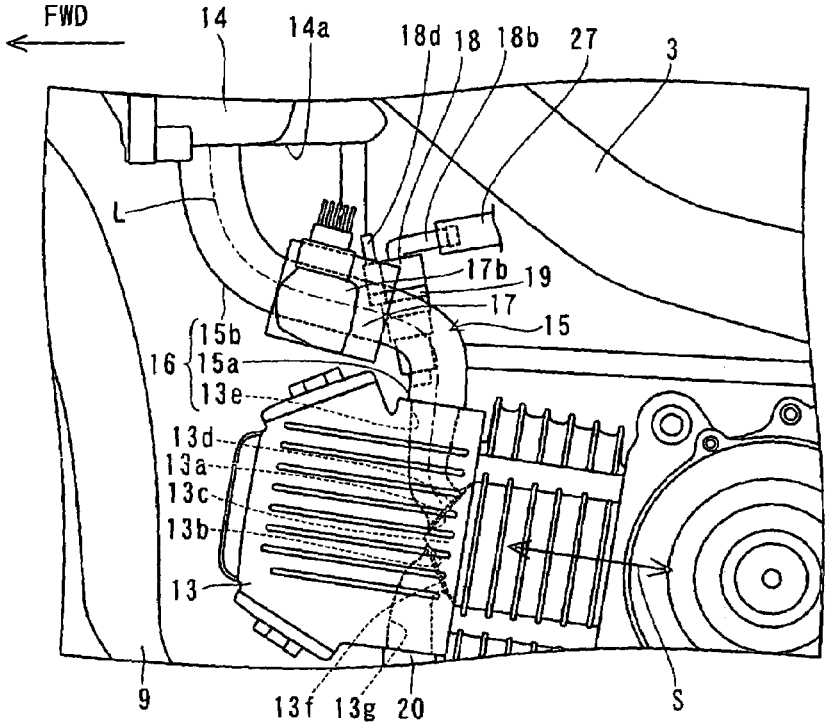
FIG. 2 is a side view of an engine and its surroundings of the motorcycle according to the preferred embodiment shown in FIG. 1.

FIG. 1 is a side view of a motorcycle according to a preferred embodiment of the present invention, showing the entire structure. FIG. 2 is a side view of an engine and its surroundings of the motorcycle according to the preferred embodiment shown in FIG. 1. FIGS. 3 through 10 are illustrations of the detailed structure of the motorcycle according to the preferred embodiment shown in FIG. 1. The arrow FWD in the drawings indicates the forward direction in which the motorcycle 1 moves. In a preferred embodiment of the present invention, an underbone type motorcycle is described as an example of the vehicle of the present invention. A frame (main frame) of this underbone type motorcycle, which is interposed between a seat and handlebars, is positioned lower to help a rider easily straddle the vehicle. With reference to FIGS. 1 through 10, the detailed structure of the motorcycle according to preferred embodiments of the present invention is described as follows.

An underbone type motorcycle 1 of the present preferred embodiment of the invention preferably includes a head pipe 2 and a main frame 3 connecting its front end to the head pipe 2, as shown in FIG. 1. The main frame 3 is arranged to extend downward to the rear. A rear arm bracket 4 is connected to the rear end of the main frame 3. A seat rail 5 is connected to the main frame 3. Between the rear end of the main frame 3 and a central portion of the seat rail 5, a backstay 6 is connected. The head pipe 2, main frame 3, rear arm bracket 4, seat rail 5 and backstay 6 define a body frame.

A pair of front forks 7 is mounted at the bottom of the head pipe 2. A front wheel 8 is rotatably mounted to the bottom ends of the front forks 7. Above the front wheel 8, a front fender 9 is disposed to cover the front wheel 8 from above. Handlebars 10 for steering are fixed to a top end of the head pipe 2. A rear view mirror 11 is fixed to the handlebars 10 on their inner sides. A headlight 12 is disposed forward of the handlebars 10 on their inner sides.

Figure 3:
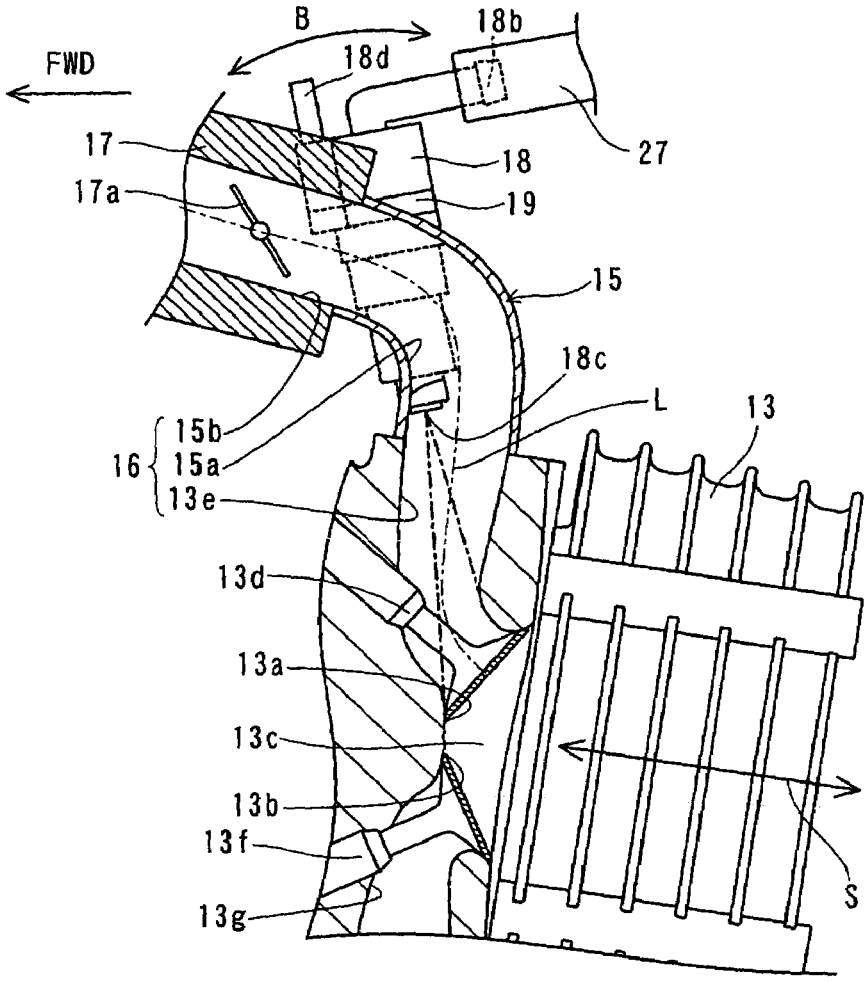
FIG. 3 is a side view of the engine and its surroundings of the motorcycle according to the preferred embodiment shown in FIG. 1.
Figure 4:
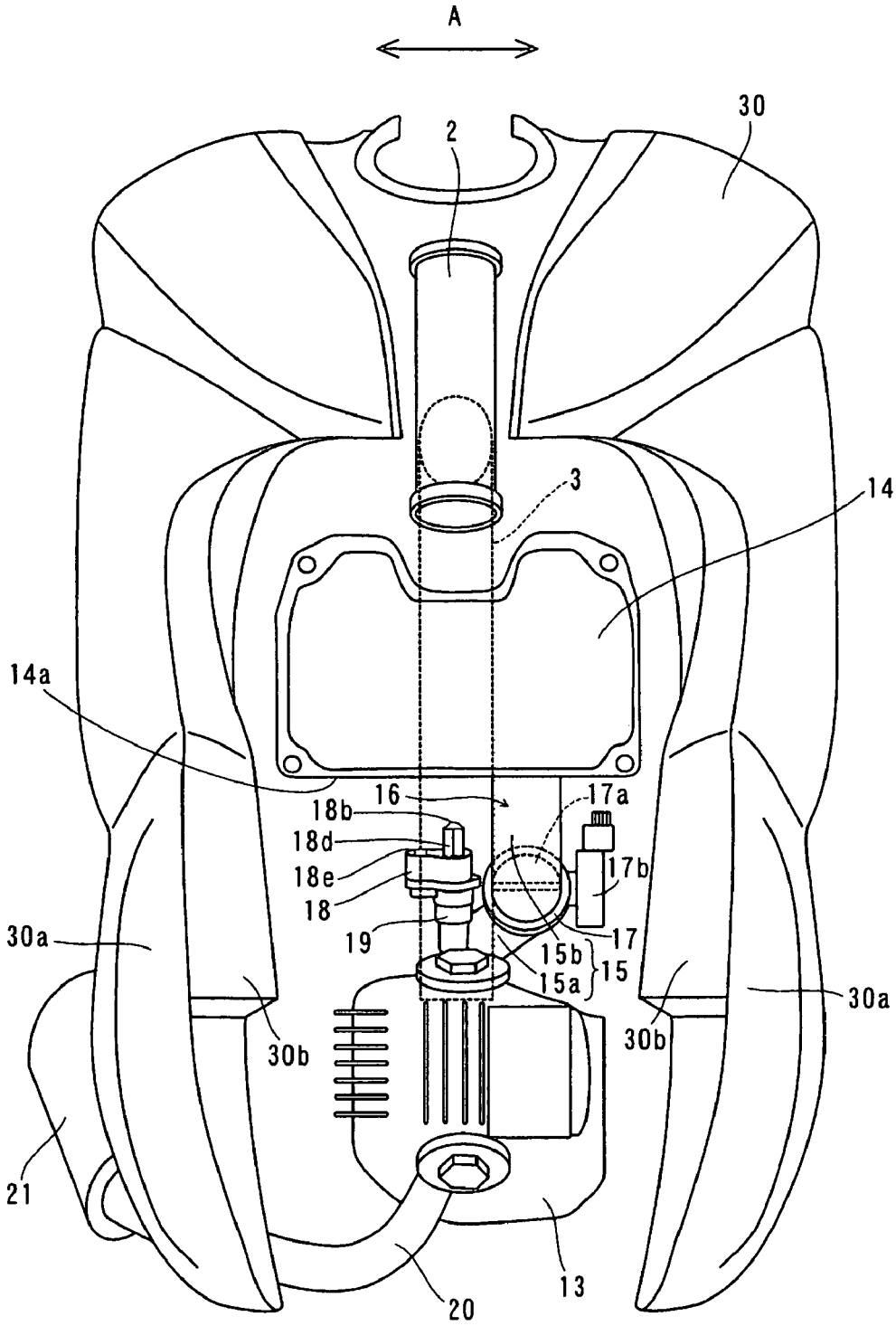
FIG. 4 is a front view of the engine and its surroundings as well as a body cover of the motorcycle according to the preferred embodiment shown in FIG. 1.

As shown in FIGS. 1 and 4, an engine 13 is disposed beneath the main frame 3. As shown in FIGS. 2 and 3, the engine 13 is arranged such that the axial direction of a cylinder (not shown), or "S" direction, is substantially horizontal. The engine 13 includes a combustion chamber 13*c* having an inlet port 13*a* and an exhaust port 13*b*, an intake valve 13*d* for opening/closing the inlet port 13*a* of the combustion chamber 13*c*, an intake passage portion 13*e* for supplying gasoline and air to the combustion chamber 13*c*, an exhaust valve 13*f* for opening/closing the exhaust port 13*b* of the combustion chamber 13*c*, and an exhaust passage portion 13*g* for emitting exhaust gas from the combustion chamber 13*c*. The intake passage portion 13*e* is an example of the "first intake passage portion" of the present preferred embodiment. The intake passage portion 13*e* is arranged to continue from the inlet opening 13*a*. An upper section of the intake passage portion 13*e* is arranged to extend upward substantially in the vertical direction. The exhaust passage portion 13*g* is arranged to extend downward.

As shown in FIG. 1, an air cleaner 14 is provided forward and upward of the engine 13 to purify air to be supplied to the engine 13. The air cleaner 14 is disposed forward and upward of the fuel injector 18, as shown in FIGS. 2 and 4. The air cleaner 14 has a bottom surface 14*a* extending in the lateral direction ("A" direction in FIG. 4) and longitudinal direction of the vehicle body. Also, the air cleaner 14 is connected to the intake passage portion 13*e* (see FIG. 2) of the engine 13 via an intake pipe 15.

In the present preferred embodiment of the invention, as shown in FIGS. 2, 4, 7 and 8, the intake pipe 15 includes an intake passage portion 15*a* having a section bent in the lateral direction of the vehicle body ("A" direction in FIGS. 4, 7 and 8) and a section extending obliquely upward to the front (FWD direction in FIGS. 2 and 8) and an intake passage portion 15*b* arranged to continue from the end of the portion of the intake passage portion 15*a* which extends obliquely upward to the front and extend forward and upward. The intake passage portion 15*a* is an example of the "second intake passage portion" of the present preferred embodiment. The intake passage portion 15*b* is an example of the "third intake passage portion" of the present preferred embodiment. The end of the portion of the intake passage portion 15*a*, which curves in the lateral direction of the vehicle body, is arranged to continue from the intake passage portion 13*e* (see FIGS. 2 and 7) of the engine 13. The intake passage portion 15*b* is connected to the air cleaner 14 as shown in FIG. 1. More specifically, the intake passage portion 13*e* of the engine 13 and the intake passage portions 15*a* and 15*b* of the intake pipe 15 define an intake passage 16 that is arranged to supply air from the air cleaner 14 to the engine 13. As shown in FIG. 4, a throttle body 17 is attached to the intake passage portion 15*b* of the intake pipe 15. The throttle body has a throttle valve 17*a* (see FIG. 3) and a throttle opening sensor 17*b* both designed to control the quantity of air to be supplied to the engine 13.

Figure 5:
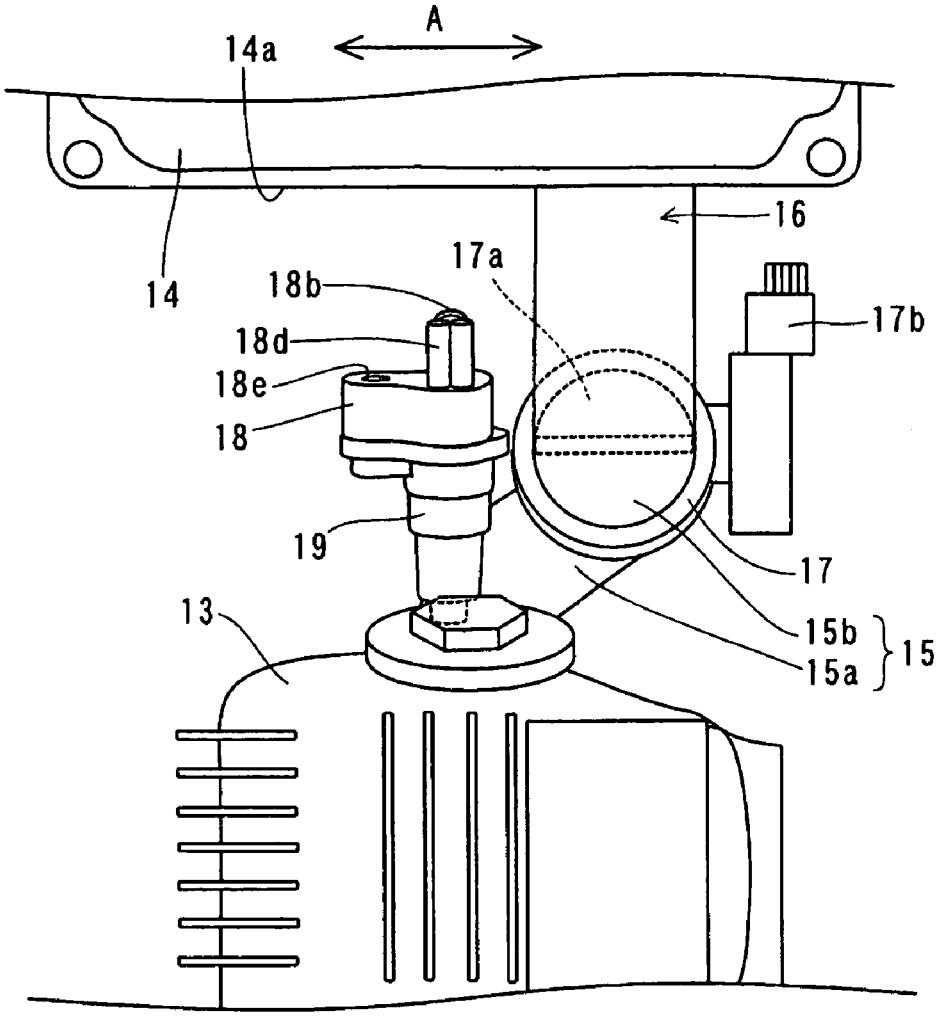
FIG. 5 is a front view of the fuel injector and its surroundings of the motorcycle according to the preferred embodiment shown in FIG. 1.
Figure 6:
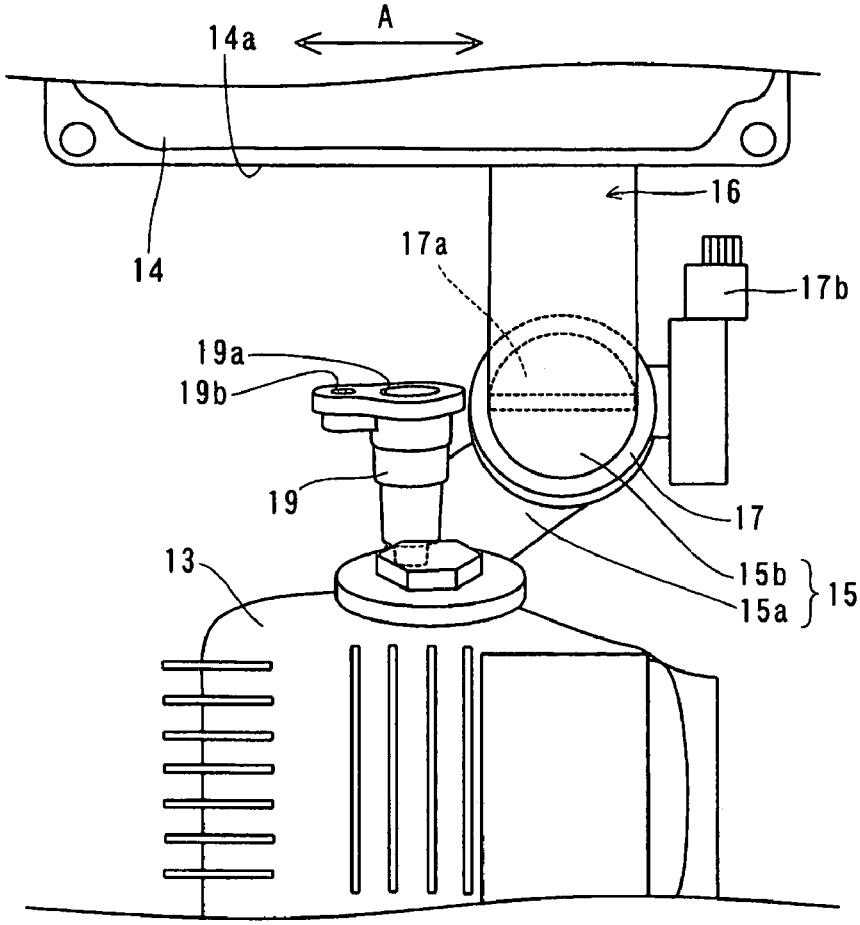
FIG. 6 is a front view, showing the fuel injector of the motorcycle according to the preferred embodiment shown in FIG. 5 removed from a mounting member.
Figure 7:
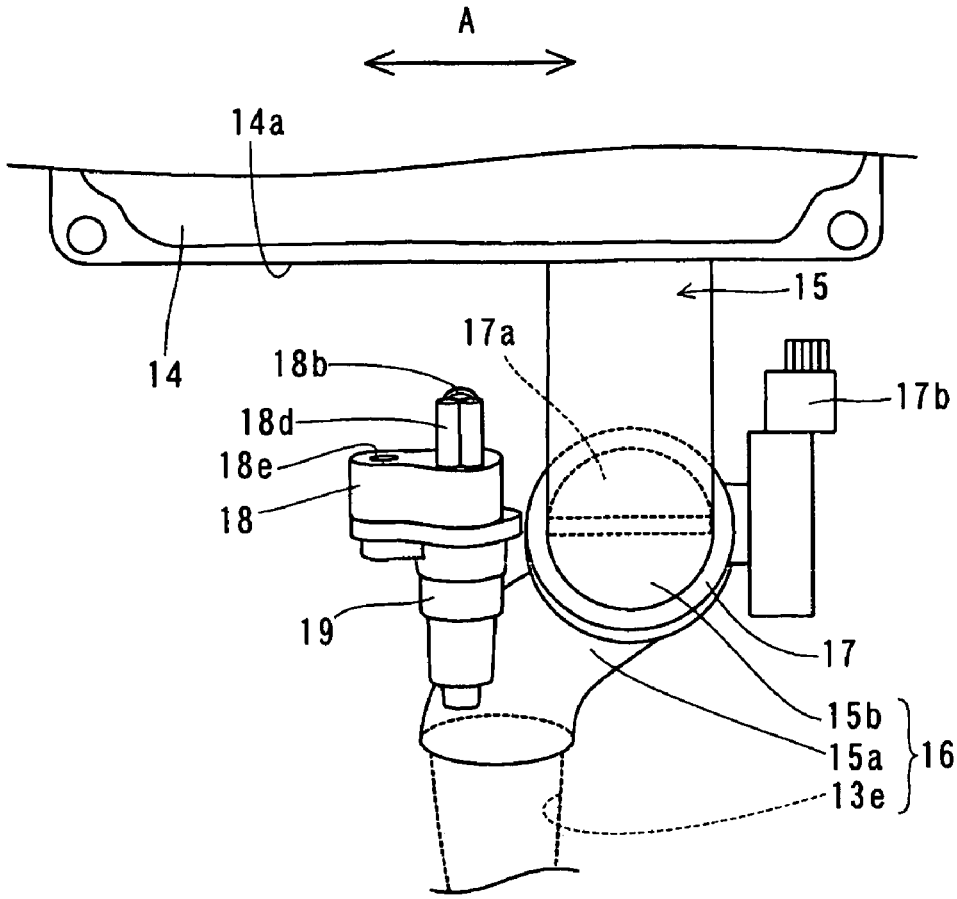
FIG. 7 is a front view of the fuel injector and its surroundings of the motorcycle according to the preferred embodiment shown in FIG. 1.

In the present preferred embodiment of the invention, the fuel injector 18 for supplying gasoline to the engine 13 (see FIG. 5) is fixed to the intake passage portion 15*a* of the intake pipe 15 through a metal mounting member 19, as shown in FIGS. 5 and 7. The mounting member 19 has, as shown in FIG. 6, an insertion hole 19*a* through which the fuel injector 18 is inserted and a screw hole 19*b* through which the fuel injector 18 is screwed. As shown in FIG. 7, the mounting member 19 is attached to the intake passage portion 15*a* of the intake passage 16 or a portion bent in the lateral direction ("A" direction in FIG. 7) of the vehicle body. In addition, the mounting member 19, which is attached to the intake passage portion 15*a* or the portion bent in the lateral direction ("A" direction in FIG. 7) of the vehicle body, extends substantially upward in the vertical direction, as shown in FIGS. 5 and 7.

Figure 9:
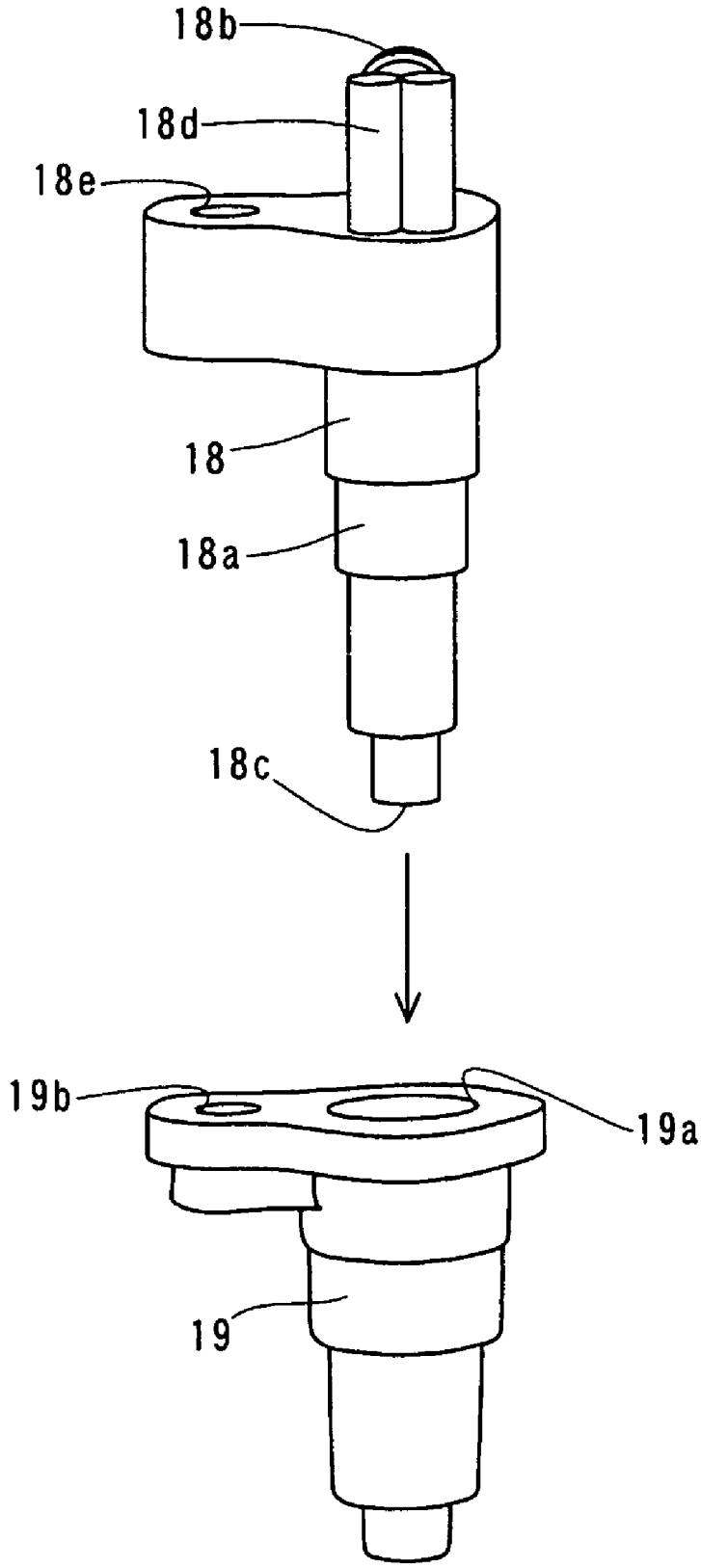
FIG. 9 is a front view of the fuel injector of the motorcycle according to the preferred embodiment shown in FIG. 1 to be mounted to the mounting member.

In the present preferred embodiment of the invention, the fuel injector 18 mounted to the mounting member 19 is located above the engine 13 and below the main frame 3 as shown in FIGS. 2 and 4. The fuel injector 18 is located between the engine 13 and the air cleaner 14, when viewed from the front. As shown in FIG. 9, the fuel injector 18 has an insertion portion 18*a* to be inserted into the insertion hole 19*a* of the mounting member 19, a hose mounting portion 18*b* for mounting a supply hose 27 (see FIG. 1) designed to supply gasoline, an injection portion 18*c* having plural injection holes (not shown) for injecting gasoline, a wire portion 18*d* for transmitting an electrical signal to control opening/closing of the injection holes of the injection portion 18*c*, and a screw hole 18*e* to be fastened to the mounting member 19. The insertion portion 18*a* of the fuel injector 18 is inserted through the insertion hole 19*a* of the mounting member 19. A screw (not shown) is engaged with the screw hole 18*e* of the fuel injector 18 as well as the screw hole 19*b* of the mounting member 19. As shown in FIG. 3, the injection portion 18*c* is located forward and upward of the inlet port 13*a* of the engine 13. Also, the injection portion 18*c* is located so as to inject gasoline toward the inlet port 13*a* of the combustion chamber 13*c*.

Figure 8:
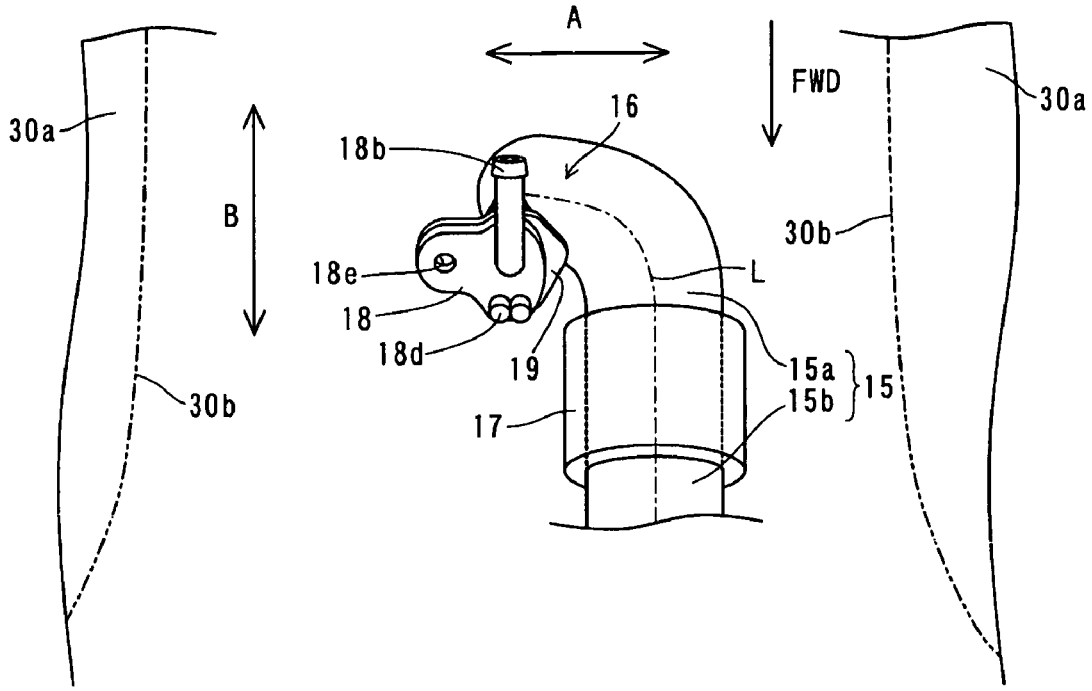
FIG. 8 is a top plan view of the fuel injector and its surroundings of the motorcycle according to the preferred embodiment shown in FIG. 1.
Figure 10:
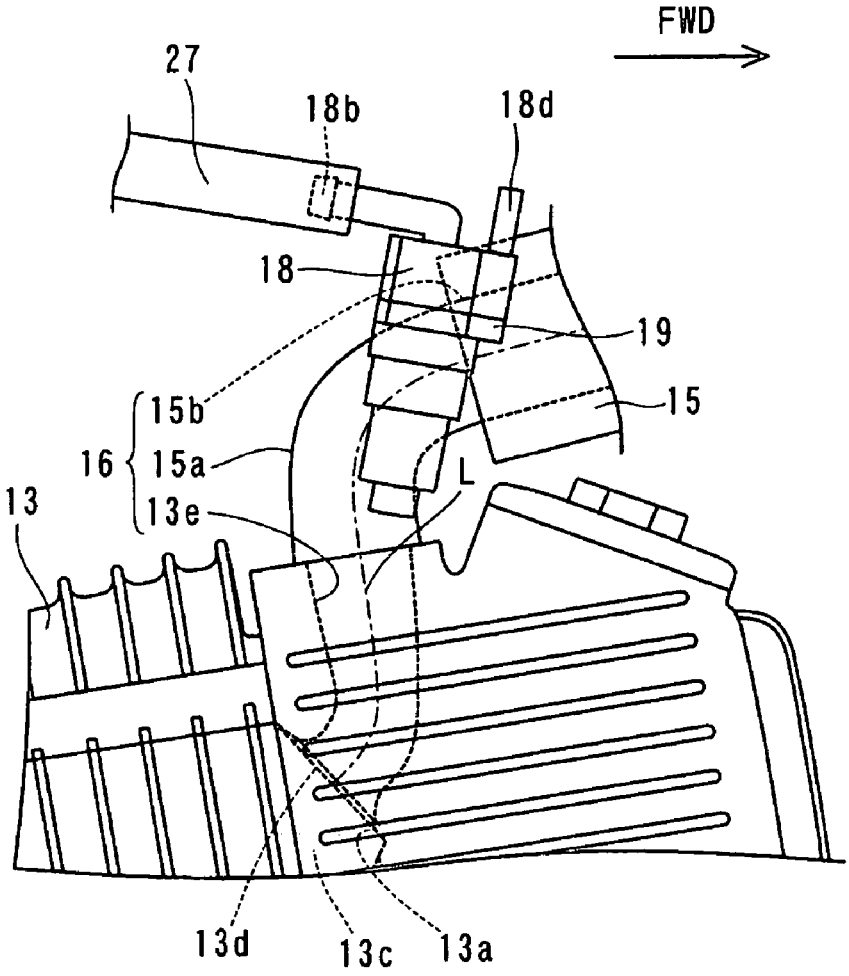
FIG. 10 is a side view of the engine and its surroundings of the motorcycle according to the preferred embodiment shown in FIG. 1, when viewed from the right side in the direction of the motorcycle motion.

In the present preferred embodiment of the invention, as shown in FIGS. 3 and 10, a position where the fuel injector 18, and thus the mounting member 19, is attached to the intake passage 16 is located forward relative to a centerline L of the intake passage portion 13*e* of the intake passage 16, when viewed from the side of the vehicle body. This helps head wind directly hit the fuel injector 18 and the mounting member 19, which ensures that a sufficient amount of head wind is used for cooling the fuel injector 18 and the mounting member 19. Cooling the mounting member 19 results in indirect cooling of the insertion portion 18*a* of the fuel injector 18, which is inserted through the insertion hole 19*a* of the mounting member 19. This can prevent the temperature of the fuel injector 18 from becoming high. The fuel injector 18 and the mounting member 19 are fixed to a connecting point of a section bent in the lateral direction of the vehicle body ("A" direction in FIG. 4) in the intake passage portion 15*a* and adjacent to the intake passage portion 13*e*. As shown in FIG. 3, the fuel injector 18 and the mounting member 19 are arranged substantially forward relative to the centerline L of the intake passage portion 13*e* of the engine 13, when viewed from the side of the vehicle body. The injection portion 18*c* of the fuel injector 18 is also arranged forward relative to the centerline L of the intake passage 16. The fuel injector 18 and the mounting member 19 are arranged rearward relative to a portion of the intake passage portion 15*b*, which is closer to the air cleaner 14, as shown in FIGS. 2 and 8.

In the present preferred embodiment of the invention, as shown in FIG. 3, the fuel injector 18 and the mounting member 19 are attached to the intake passage portion 15*a* in an arrangement that is angled forward such that the injection portion 18*c* of the fuel injector 18 is directed toward the inlet port 13*a* of the engine 13. As described above, a portion of the intake passage portion 15*a* to which the fuel injector 18 and mounting member 19 are attached is bent in the lateral direction of the vehicle body ("A" direction in FIG. 4). This prevents the topside of the fuel injector 18 from touching the intake passage 16, even though the injection portion 18*c* of the fuel injector 18 is angled forward or rearward ("B" direction in FIGS. 3 and 8).

As shown in FIGS. 5 and 7, the fuel injector 18 and the mounting member 19 are positioned such that their front sides are not covered with the intake 5 passage 16 (intake passage portion 15*b*). Also, the intake passage 16 is not arranged behind the fuel injector 18 thus providing a space at the rear of the fuel injector 18 where it is attached to the intake passage portion 15*a* that is bent in the lateral direction ("A" direction in FIG. 4) of the vehicle body.

An exhaust pipe 20 is attached to the exhaust passage portion 13*g* of the engine 13 as shown in FIG. 1. As shown in FIGS. 1 and 4, the exhaust pipe 20 curves toward the right in the direction of the vehicle motion (direction indicated by the arrow FWD), then extends rearward and then connects to a muffler 21.

The rear arm bracket 4 connecting to the main frame 3 is provided with a pivot shaft 22. The pivot shaft 22 supports the rear arm 23, allowing its rear end to swing up/down. A rear wheel 24 is rotatably attached to the rear end of the rear arm 23. The seat rail 5 supports the rear arm 23 through a rear shock absorber 25. A metal fuel tank 26 is installed above the seat rail 5. One end of the rubber supply hose 27 is attached to the outside bottom of the fuel tank 26. The other end of the supply hose 27 is attached to a hose mounting portion 18*b* of the fuel injector 18, as shown in FIG. 2. A fuel pump 28 is fixed to the supply hose 27 which is arranged to supply gasoline from the fuel tank 26 to the fuel injector 18, as shown in FIG. 1. A seat 29 is disposed above the fuel tank 26. A body cover 30 is mounted to extend from the front to the rear of the vehicle body so that it can cover the head pipe 2 and the seat rail 5.

As shown in FIGS. 1 and 4, a pair of leg shields 30*a* is provided forward of the body cover 30 with a given distance therebetween in the lateral direction of the vehicle body ("A" direction in FIG. 4) relative to the direction the vehicle moves (indicated by the arrow FWD in FIG. 1). The pair of leg shields 30*a* is disposed so as to sandwich the fuel injector 18 from both sides as shown in FIGS. 4 and 8. The leg shields 30*a* have an inner side surface 30*b* extending in the direction of the vehicle body height and longitudinal length. The inner side surfaces 30*b* of the pair of leg shields 30*a* are arranged such that a distance between them becomes greater toward the front. The body cover 30 has a rear fender 31 attached to its rear end as shown in FIG. 1. The rear fender is designed to cover the rear wheel 24 from above.

In the present preferred embodiment of the invention, as described above, the intake passage 16 is provided with the intake passage portion 13*e* that is arranged to continue from the inlet port 13*a* of the engine 13 and have an upper section extending upward substantially in the vertical direction. The intake passage portion 15*a* is arranged to continue from the upper section of the intake passage portion 13*e* and have a section bent in the lateral direction of the vehicle body ("A" direction in FIG. 4). Also, the fuel injector 18 is attached to the section bent in the lateral direction of the vehicle body ("A" direction in FIG. 4) in the intake passage portion 15*a*. This can prevent the topside of the fuel injector 18 from touching the intake passage 16, even though the fuel injector 18 is angled forward. Therefore, the layout flexibility for the fuel injector 18 to the intake passage portion 15*a* of the intake passage 16 can be improved. The fuel injector 18 is mounted to the section bent in the lateral direction of the vehicle body ("A" direction in FIG. 4) in the intake passage portion 15*a* which is arranged to continue from the intake passage portion 13*e* that has the upper section extending upward substantially in the vertical direction. This allows the injection portion 18*c* of the fuel injector 18 to be arranged in the direction in which the intake passage portion 13*e* of the intake passage 16 extends. This can prevent fuel from sticking to the inner wall surface of the intake passage 16.

In the present preferred embodiment of the invention, the fuel injector 18 is disposed adjacent to the connecting point of the section that is bent in the lateral direction of the vehicle body ("A" direction in FIG. 4) in the intake passage portion 15*a* and the intake passage portion 13*e*. This allows the injection potion 18*c* of the fuel injector 18 to be closer to the inlet port 13*a* of the engine 13, which can further prevent fuel from sticking to the inner wall surface of the intake passage 16. This also allows the fuel injector 18 to be positioned at a lower section of the intake passage portion 15*a*, and therefore allows the top end of the fuel injector 18 to be positioned lower. Thus, the height of the main frame 3 of the body frame disposed above the fuel injector 18 can be reduced so that a rider can easily get on and off the vehicle.

In the present preferred embodiment of the invention, the fuel injector 18 is disposed below the main frame 3 of the body frame so that the fuel injector 18 can be accommodated in the space between the main frame 3 of the body frame and the engine 13.

In the present preferred embodiment of the invention, the fuel injector 18 is mounted in a position that is angled forward from the vehicle body, which allows the top end of the fuel injector 18 to be positioned lower.

In the present preferred embodiment of the invention, the inlet port 13*a* of the engine 13 is arranged rearward of the injection portion 18*c* of the fuel injector 18, when viewed from the side of the vehicle body, and the injection portion 18*c* of the fuel injector 18 is arranged forward relative to the centerline L of the intake passage 16 (intake passage portion 15*a*), when viewed from the side of the vehicle body. This allows the injection portion 18*c* of the fuel injector 18 to be easily directed to the inlet port 13*a* of the engine 13, which can easily prevent fuel from sticking to the inner wall surface of the intake passage 16 (intake passage portion 13*e*) of the engine 13.

In this preferred embodiment, the fuel injector 18 is disposed above the engine 13, which can protect the fuel injector 18 from stones thrown from below.

In the present preferred embodiment of the invention, the fuel injector 18 is positioned such that its front side is not covered by the intake passage 16 (intake passage portion 15*b*). This can prevent the fuel injector 18 from touching the intake passage 16 (intake passage portion 15*b*), even though the fuel injector 18 is angled forward. Thus, the layout flexibility for the fuel injector 18 to the intake passage portion 15*a* can be improved. The intake passage 16 is provided with the intake passage portion 15*b* extending upward and forward from the intake passage portion 15*a*, and the fuel injector 18 is positioned such that its front side is not covered by the intake passage 16 (intake passage portion 15*b*). This allows installation and maintenance of the fuel injector 18 to be done from the front of the vehicle body. Unlike the installation and maintenance of the fuel injector 18 from the back of the intake passage 16, the body cover 30 and the engine 13 need not be removed. This can facilitate installation and maintenance of the fuel injector 18.

In the present preferred embodiment of the invention, a position where the fuel injector 18 is attached to the intake passage 16 is located forward relative to the centerline L of the intake passage 16 (intake passage portion 15*a*), when viewed from the side of the vehicle body. This allows installation and maintenance of the fuel injector 18 from the front of the vehicle body, which can further facilitate the installation and maintenance of the fuel injector 18.

In this preferred embodiment, the mounting member 19, designed to mount the fuel injector 18 to the intake passage 16, also facilitates attachment of the fuel injector 18 to the intake passage portion 15*a* of the intake passage 16.

It should be conceivable that the present preferred embodiment is disclosed herein simply for the purpose of showing an example in all respects, rather than the limitations. The scope of the present invention is not defined by the description of the present preferred embodiment, but defined by the scope of the claims, and includes the meanings equivalent to those of the scope of the claims as well as any modifications that fall within the scope of the claims.

For example, the above-described preferred embodiment shows an underbone type of motorcycle with a lower positioned main frame, as an example of the vehicle. However, the present invention is not limited to that. Other vehicles, including different types of motorcycles other than the underbone type motorcycle, such as three-wheelers and all terrain vehicles (ATV), are also applicable as long as the vehicle is provided with a fuel injector for supplying fuel to the engine.

Figure 11:
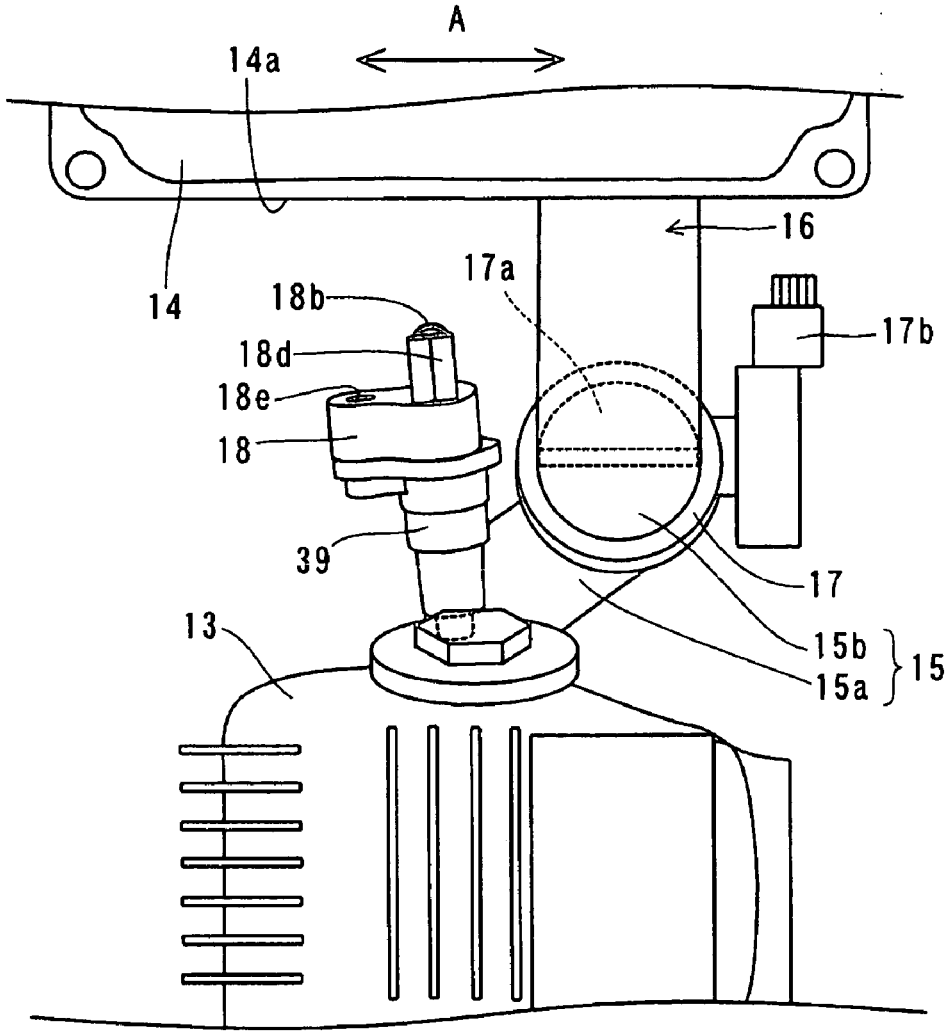
FIG. 11 is a front view of the fuel injector of the motorcycle according to a first variation of a preferred embodiment of the invention.

The above-described preferred embodiment shows the example in which the mounting member and the fuel injector are mounted in a substantially upstanding position, when viewed from the front of the vehicle body. However, the present invention is not limited to that. As shown by the first variation of the preferred embodiment of the invention in FIG. 11, the mounting member 39 and the fuel injector 18 may be mounted in a position that is angled to the lateral direction of the vehicle body ("A" direction in FIG. 11), when viewed from the front of the vehicle body in FIG. 11. In such case, as the top end of the fuel injector 18 can be positioned lower, the main frame of the body frame can be positioned lower accordingly. This allows the body cover of the main frame to be positioned lower so that a rider can easily straddle the body cover when he/she gets on and off the vehicle. As a result, the rider can easily get on and off the vehicle.

The above-described preferred embodiment shows the example in which the injection portion of the fuel injector and the position to which the fuel injector is mounted are arranged forward relative to the centerline of the intake passage when viewed from the side of the vehicle body. However, the present invention is not limited to that. The injection portion of the fuel injector and the position to which the fuel injector is mounted may be arranged on or rearward relative to the centerline of the intake passage.

Figure 12:
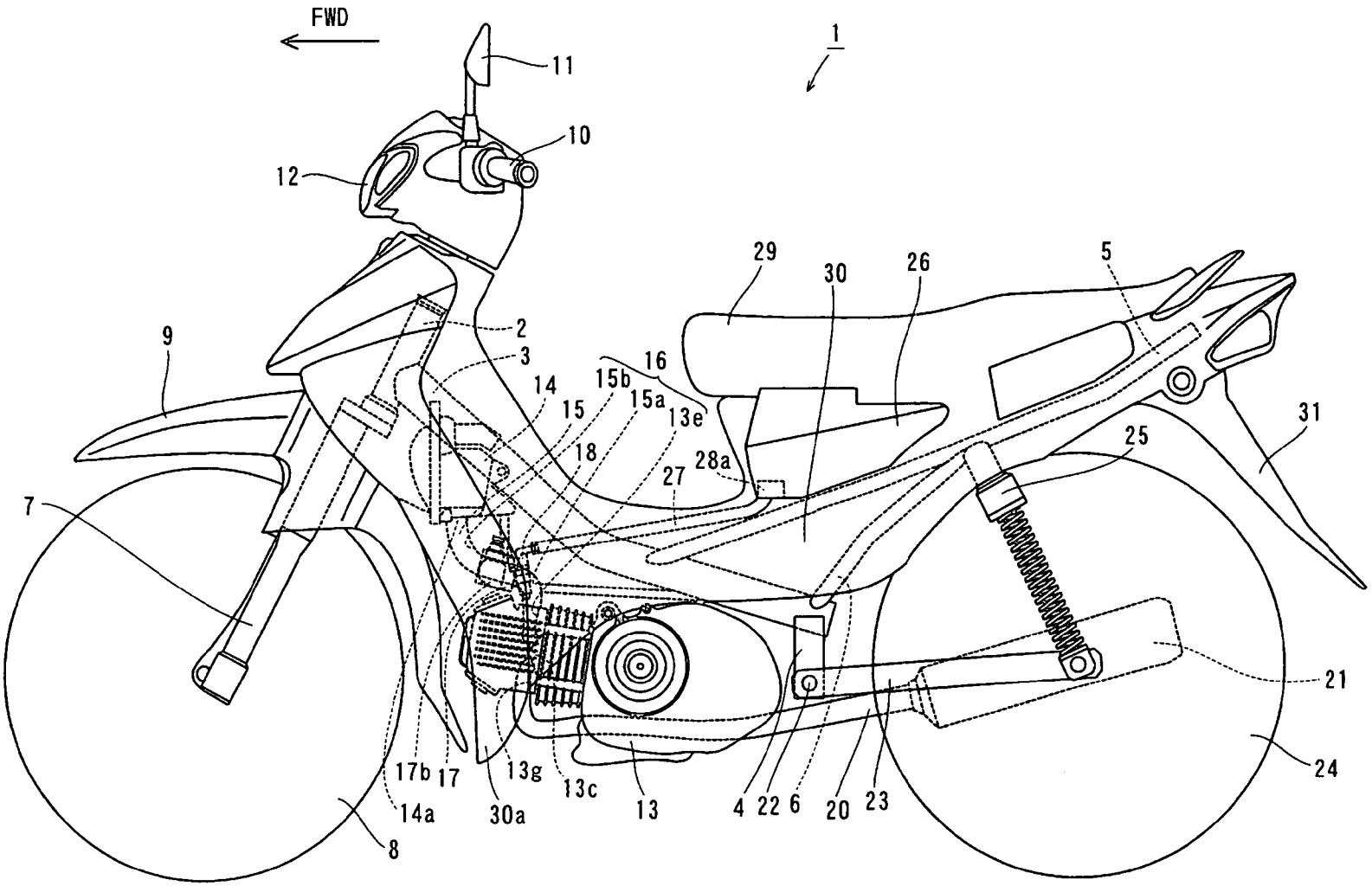
FIG. 12 is a side view of a fuel pump of the motorcycle according to a second variation of a preferred embodiment of the invention.

The above-described preferred embodiment shows the example in which the fuel pump is fixed to the supply hose mounted to the outside of the fuel tank. However, the present invention is not limited to that. As shown by the second variation in FIG. 12, the fuel pump 28*a* may be disposed inside of the fuel tank 26.

The above-described preferred embodiment shows the example in which the mounting member is angled forward for attachment to the intake passage. However, the present invention is not limited to that. The mounting member may not be angled in the longitudinal direction for attachment to the intake passage or it may be angled rearward for attachment to the intake passage.

The above-described preferred embodiment shows the example in which the fuel injector is mounted to the intake passage through the mounting member. However, the present invention is not limited to that. The fuel injector may be mounted directly to the intake passage.

The above-described preferred embodiment provides an example in which the fuel injector is disposed below the body frame. However, the present invention is not limited to that. The fuel injector may be positioned in any area except below the body frame.

What is claimed is:

1. A vehicle comprising:

a head pipe;

a body frame coupled with the head pipe and extending downward to the rear;

an engine arranged below the body frame and having an inlet port, a cylinder axis of the engine being oriented substantially horizontal;

an intake passage arranged to supply air to the engine; and a fuel injector mounted on a midsection of the intake passage and arranged to supply fuel to the engine; wherein the intake passage includes a first intake passage portion arranged to continue from the inlet port of the engine and have an upper section that extends upward substantially in the vertical direction and a second intake passage portion arranged to continue from the upper section of the first intake passage portion and have a section bent in the lateral direction of the vehicle; and the fuel injector is mounted to the second intake passage portion having the section that is bent in the lateral direction of the vehicle.

2. The vehicle according to claim 1, wherein the fuel injector is disposed adjacent to a connecting point of the section bent in the lateral direction of the second intake passage portion with the first intake passage portion.

3. The vehicle according to claim 1, wherein the fuel injector is disposed below the body frame.

4. The vehicle according to claim 1, wherein the fuel injector is mounted in a position that is angled to the lateral direction of the vehicle, when viewed from the front of the vehicle.

5. The vehicle according to claim 1, wherein the fuel injector is mounted in a position that is angled forward of the vehicle, when viewed from the side of the vehicle.

6. The vehicle according to claim 5, wherein the fuel injector has an injection portion arranged to inject the fuel, the inlet port of the engine is arranged rearward of the injection portion of the fuel injector when viewed from the side of the vehicle, and the injection portion of the fuel injector is arranged forward relative to a centerline of the intake passage when viewed from the side of the vehicle.

7. The vehicle according to claim 1, wherein the fuel injector is disposed above the engine.

8. The vehicle according to claim 1, wherein the intake passage further includes a third intake passage portion arranged to continue from the second intake passage portion, the third intake passage portion arranged forward of the fuel injector and extending upward, and wherein the third intake passage portion is disposed not to cover the front side of the fuel injector.

9. The vehicle according to claim 1, wherein a position where the fuel injector is mounted to the intake passage is located forward relative to a centerline of the intake passage, when viewed from the side of the vehicle.

10. The vehicle according to claim 1, further comprising a mounting member arranged to mount the fuel injector to the intake passage.

11. The vehicle according to claim 1, wherein the intake passage portion having a section bent in the lateral direction of the vehicle creates an empty space rearward of where the fuel injector is mounted to the intake passage.

12. The vehicle according to claim 1, further comprising a supply hose connected to the fuel injector and a fuel pump fixed to the supply hose.

13. The vehicle according to claim 1, further comprising a fuel tank and a fuel pump, wherein the fuel pump is disposed inside the fuel tank.

* * * * *